United States Patent [19]

Jordal

[11] Patent Number: 4,855,716

[45] Date of Patent: Aug. 8, 1989

[54] SECURITY AWNING WINDOW

[76] Inventor: Robert L. Jordal, Rte. 10, Box 351, Winston-Salem, N.C. 27127

[21] Appl. No.: 203,341

[22] Filed: Jun. 6, 1988

[51] Int. Cl.[4] ..... G08B 13/02

[52] U.S. Cl. ..... 340/550; 49/74; 49/90; 340/541; 340/665

[58] Field of Search ..... 49/90, 91, 92, 74; 160/90, 92; 340/550, 541, 665

[56] References Cited

U.S. PATENT DOCUMENTS 3,058,175 10/1962 Keulemans ..... 49/90

4,813,183 3/1989 Jordahl ..... 49/74

*Primary Examiner*—Glen R. Swann, III

[57] ABSTRACT

A security awning window is presented with increased safety factors which grant protection against both adverse weather conditions and unauthorized entry. Alarm struts span the window which, if deflected act as a switch for an audible alarm and also engage the panels to provide increased burglar or adverse weather protection.

10 Claims, 3 Drawing Sheets

SECURITY AWNING WINDOW

BACKGROUND OF THE INVENTION

1. Field Of The Invention

The present invention relates to windows used in conventional buildings such as houses and particularly to windows that open by pivoting outwardly from their frames.

2. Description Of The Prior Art And Objectives Of The Invention

With the recent increase in the crime rate, in certain populated areas more and more home owners have attempted to secure their dwelling and other buildings from unauthorized intrusions. Various types of security systems and alarms have been have been devised such as shown in the jalousie alarm system of U.S. Pat. No. 4,449,121 whereby a jalousie-type window is connected to an alarm system wherein a deflection of the alarm strut or shaft will cause electrical contact to be made thereby activating an audio alarm. Also, a rotatable saw-bar is included in the alarm strut which will prevent the alarm shaft from being removed or cut by sawing. Other types of securty locks, alarms and devices have been made for a variety of window types. However, such prior art devices usually have certain weakness and problems associated therewith. Also, in recent years changes have been made in building codes for windows to help protect buildings and their contents in adverse weather conditions such as during hurricanes, windstorms and the like.

With the aforesaid problems and conditions understood, the present invention was conceived and one of its objectives is to provide an awning window which can be easily installed by a building contractor and which will provide both burglar and weather protection.

It is another objective of present invention to provide an awning window which include a rotatable transparent panel with a J-shaped lip which will engage a lip receptacle attached to the frame upon closing.

It is yet another objective of the present invention to provide an awning window with an alarm strut having an anti-saw bar and having an alarm switch mechanism therein.

It is also an objective of the invention to provide an awning window with an alarm strut with a panel lip receptacle attached thereto.

It is also an objective of the present invention to provide an awning window having a window sill with a lip receptacle affixed thereto for engagement with the lowermost panel.

Various other objectives and advantages of the invention will become apparent to those skilled in the art as the invention set forth in more detail below.

SUMMARY OF THE INVENTION

The aforesaid and other objectives are achieved by providing an awning window having a rectangular frame consisting of a header, sill and opposingly positioned side jambs. One or more rotatable glass panels are affixed to the frame and a mechanical drive mechanism is provided whereby the panels can be opened or closed as desired. Alarm struts are joined on the inside of the frame behind the panels and include anti-saw bars. Electrical contacts are connected to the alarm strut so if the alarm strut is twisted or bent such as may occur during a burglary attempt, an audible alarm is set off. At the bottom of each of the panels a J-shape lip is provided which will engage a lip receptacle which may be positioned on the alarm strut for the upper panels and for the lower panel may be positioned on the frame sill.

As in the conventional awning windows, as the window is closed the panels rotates inwardly and contacts the frame and upon continued rotation of the drive mechanism handle the panel raises slightly for example one quarter (¼") of an inch within the frame whereby the lip and receptacle make full engagement and therefore prevent the panel from being pried or forced outwardly as may occur during a burglary attempt or during a severe storm.

FIG. *2a* provides a cross-sectional view of the closed awning window with certain portions enlarged as shown in FIGS. *2b* and *2c;*

Figure 1:
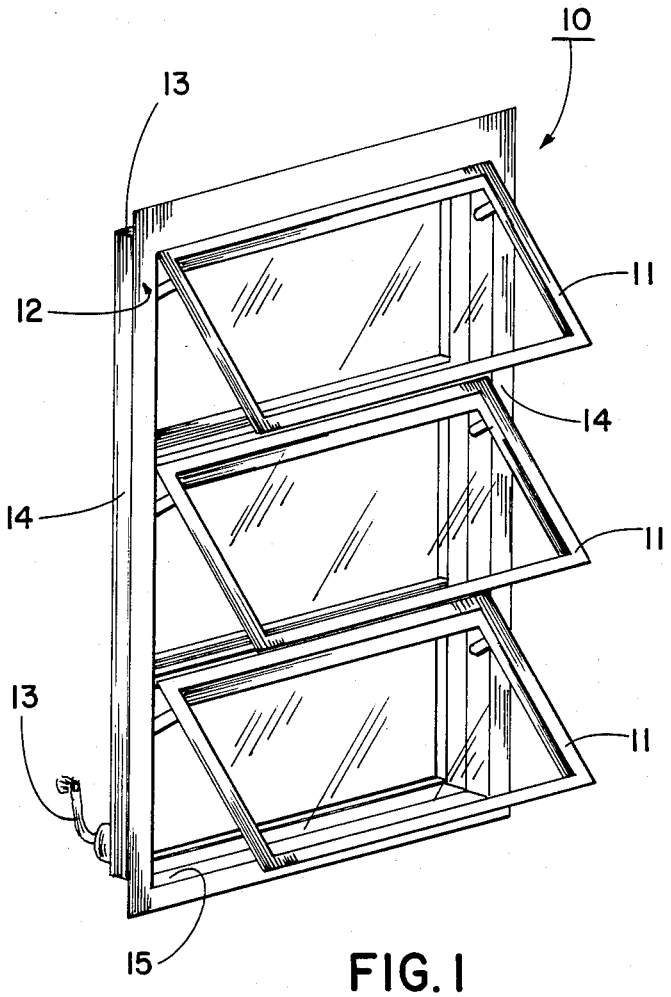
FIG. 1 depicts a typical embodiment of the awning window of the invention having three (3) rotatable panels affixed to a rectangular frame.
Figure 5:
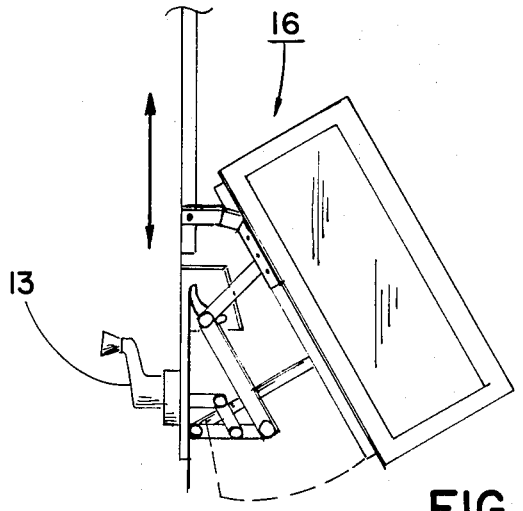
Figure 3:
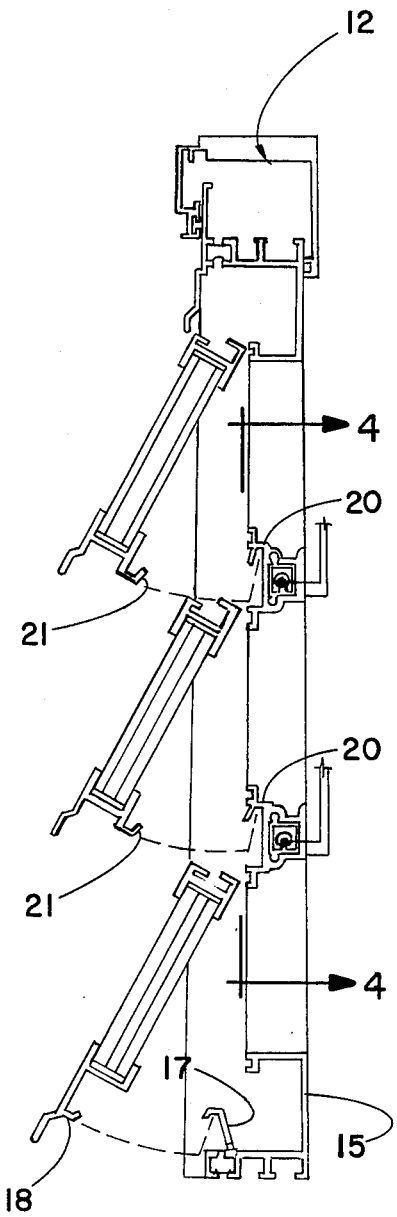
Figure 4:
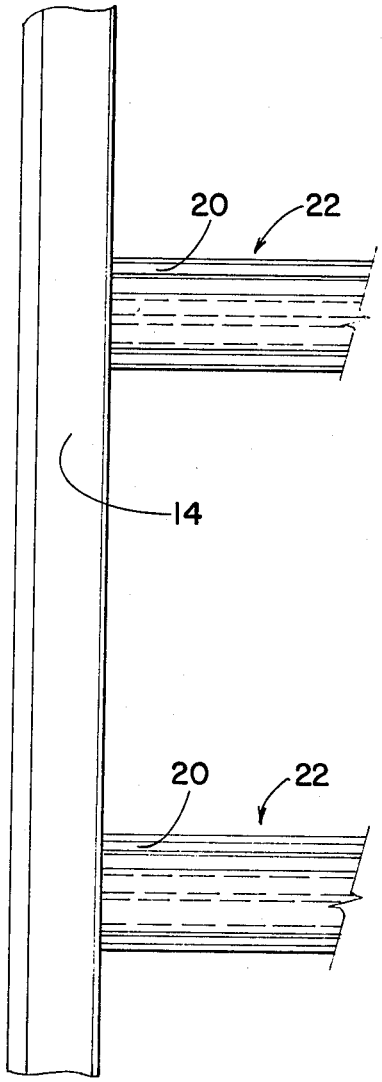

FIG. 3 demonstrates a side-elevational cross sectional view of the window as shown in FIG. 1 with the panels opened;

FIG. 4 shows a portion of the side jamb and alarm struts as seen at 4—4 in FIG. 3;

FIG. 5 illustrates the mechanical drive mechanism of the window as shown in FIG. 1.

DESCRIPTION OF THE PREFERRED EMBODIMENT

The preferred form of the awning window of the invention includes a rectangular frame formed from extruded aluminum and includes a header, a sill and side jambs. The drive mechanism is positioned in the side jamb and a plurality of rotatable panels formed from glass are rotatably positioned within the frame. Alarm struts are mounted between the side jambs at approximately the lower edge of the upper panels. The alarm struts include an anti-saw bar and lip receptacle. Electrical connections on the struts make contact upon the struts being bent or twisted to activate an audio alarm. On the bottom of the alarm strut is attached a lip receptacle which will engage a J-shaped panel lip on the rotatable panel. A somewhat similar receptacle is provided on the frame sill whereby upon closing, the panel lips engage the lip receptacles to provide additional security and prevent the panels from being forced open as may be attempted by an intruder or by high wind conditions.

DETAILED DESCRIPTION OF THE DRAWINGS AND OPERATION OF THE INVENTION

Figure 2:
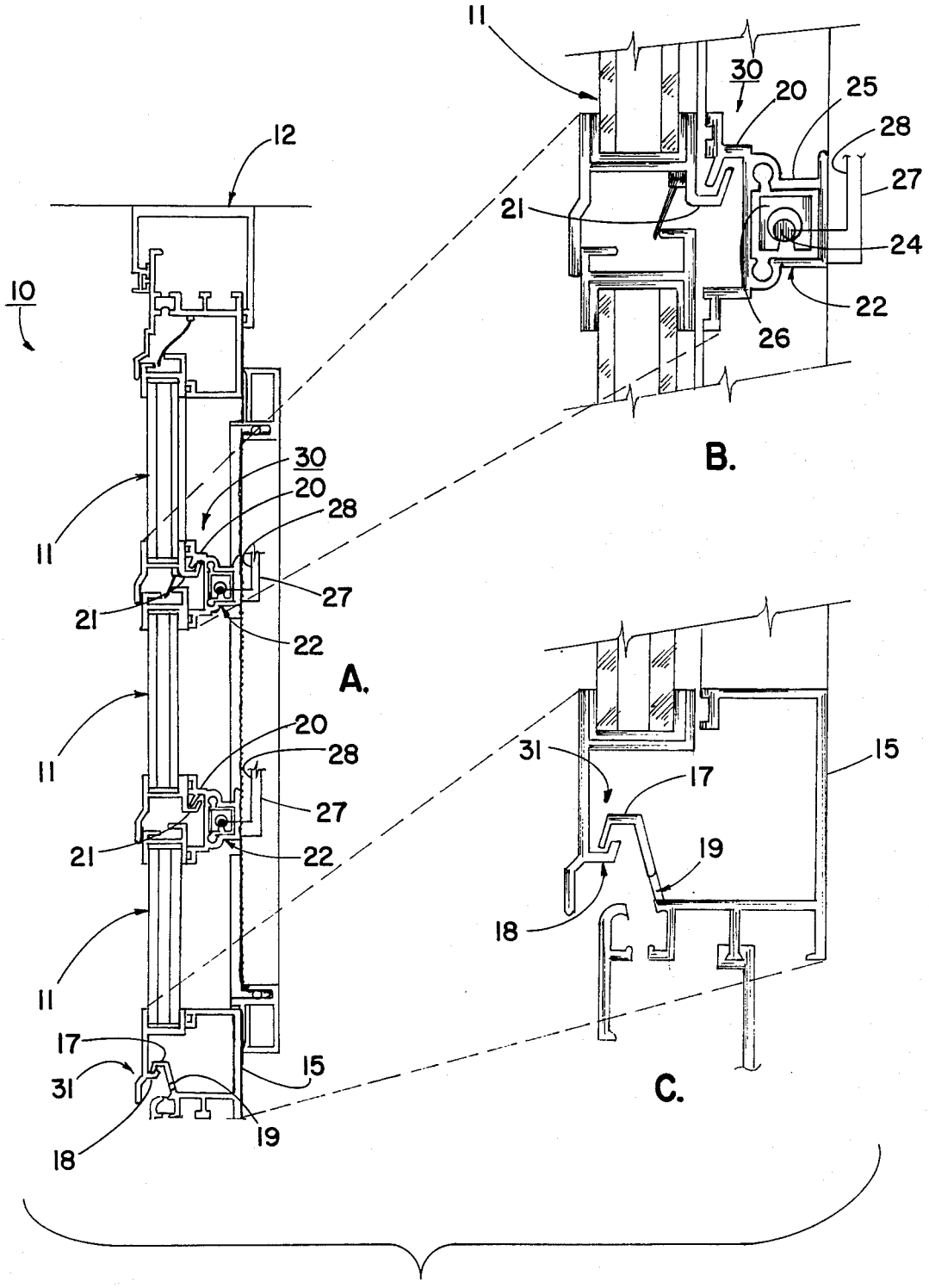

Turning to the drawings, FIG. 1 demonstrates a typical awning window 10 of the invention having a plurality of three (3) glass panels 11 contained within rectangular frame 12. Panels 11 rotate outwardly as shown in FIG. 1 to allow fresh air to enter the building and by rotating handle 13 in an opposite direction, panels 11 rotate inwardly to frame 12 as shown in FIG. 2. Panels 11 in FIG. 2 are formed from two transparent panes of glass although various other constructions such as single or triple panes of glass or other materials can be used. Frame 12 consists of aluminum extrusions which have been joined together including header 13, side jambs 14 and frame sill 15. Conventional drive mechanism 16 as shown in FIG. 5 is substantially concealed within side jambs 14 and frame sill 15 as is conventional within the trade. As is understood, drive mechanism 16 will rotate panels 11 inwardly and outwardly and upon closing, panels 11 are raised slightly within frame 12.

Rotatable latches (not shown) such as seen in U.S. Pat. No. 2,997,754 may be used on the side jambs to assist in closing the panel within the frame. As is understood, awning window 10 as shown in FIG. 1 includes three (3) transparent rotatable panels 11 although more or fewer panels may be used in particular situations. Also, a series of awning frames 12 can be affixed together to provide a wide awning window for applications needing more window area.

As further seen in FIG. 2, frame sill 15 includes lip receptacle 17 which engages panel lip 18 collectively forming latch means 31 and weep hole 19 allows any accumulated moisture to escape therefrom. Panel lip 18 is somewhat shorter than lip 21 and lip receptacle 17 adequately accomodates the engagement with panel lip 18. As seen in FIG. 2, lip receptacle 17 is positioned forward of lip receptacle 20 and therefore the arc of travel of lip 18 is somewhat different than the travel arc of lip 21. Lip 21 and lip receptacle 20 form latch means 30. Lips 18 and 21 are shown enlarged in FIGS. 2b and 2c and lip receptacle 20 is affixed to alarm strut 22 with lip receptacle 17 being affixed to frame sill 15.

Alarm strut 22 as seen in FIG. **2*b* includes anti-saw bar 24 with outer frame member 25 and inner strut member 26 connected respectively to electrical conductors 27 and 28 which would actually be inside side jambs 14. Thus, if alarm strut 22 is sufficiently deflected, contact is made between outer frame 25 and inner strut member 26 thereby alarm struts 22 act as a switch and allows electrical current to flow through conductors 27 and 28 to activate an audible alarm (not shown). Horizontal alarm struts 22 are attached to vertical jamb members 14 as shown in FIG. 1 and FIG. 4 and include lip receptacles 20. Thus, awning window 10 includes an alarm strut 22 which acts as a switch for an audible alarm in the event a burgular attempts to enter the window and, during adverse weather conditions or if windows are attempted to be forced outwardly, panel lips 18 and alarm strut receptacle 22**, by being engaged, will assist in preventing the window from being opened.

The illustrations and examples provided herein are for explanatory purposes and are not intended to limit the scope of the appended claims.

I claim:

1. A window of the awning type having a frame, said frame including a pair of opposingly positioned jambs, a header and a frame sill, said jambs joined to said header and to said frame sill, a pivotal panel positioned within said frame, a horizontal strut, said strut joined to said jambs, a panel drive mechanism, said drive mechanism joined to said frame and to said panel to pivot the panel from an open to a closed position and to raise it within the frame slightly upon closing, the improvement comprising: a panel latch means, said latch means including (a) a panel lip, and (b) a panel lip receptacle, said lip receptacle attaching to said horizontal strut whereby upon closing said panel said panel lip engages said lip receptacle to securely hold said panel within said frame.

2. A window as claimed in claim 1 wherein said horizontal strut comprises an alarm strut.

3. A window as claimed in claim 1 wherein said lip receptacle is joined to said frame sill.

4. A window of the awning type having a frame, said frame including a header, a pair of opposingly positioned vertical jambs and a frame sill, said jambs joined to said sill and to said header, a plurality of pivotal panels attached to said frame, a panel drive mechanism, said drive mechanism attached to said frame and to said panels to pivot the panels from an open to a closed position and to raise the panels slightly within the frame upon closing, the improvement comprising: panel latch means said latch means including (a) J-shaped panel lips, said lips attached to the lower portion of said panels, and (b) lip receptacles, said receptacles attached to said frame for engaging said panel lips, whereby upon closing the window said panels are securely locked to said frame by the engagement of said panel lips with said lip receptacles.

5. A window as claimed in claim 4 wherein said plurality of panels consist of three transparent panels.

6. A window as claimed in claim 4 and including a pair of alarm struts, said alarm struts attached horizontally to said frame jambs, and each of said alarm struts having one of said lip receptacles attached thereto.

7. A window as claimed in claim 4 wherein one of said plurality of lip receptacles is affixed to said frame sill.

8. A window as claimed in claim 1 and including a horizontal alarm strut, said strut attached to said frame and positioned near the bottom of said panel when said panel is in the closed position,

9. A window as claimed in claim 8 wherein said alarm strut includes an anti-saw bar.

10. A window as claimed in claim 9 wherein said alarm strut comprises an electrical alarm switch.

* * * * *